US006253741B1

(12) United States Patent
Channing

(10) Patent No.: US 6,253,741 B1
(45) Date of Patent: Jul. 3, 2001

(54) SYSTEM FOR PREVENTING FUEL PUMP AIR INGESTION

(75) Inventor: Derek Albert Channing, Livonia, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/487,090

(22) Filed: Jan. 19, 2000

(51) Int. Cl.[7] ..... F02M 37/04
(52) U.S. Cl. ..... 123/516; 123/198 DB
(58) Field of Search ..... 123/516, 510, 123/512, 514, 198 D, 198 DB

(56) References Cited

U.S. PATENT DOCUMENTS

| | | | |
|---|---|---|---|
| 4,124,013 | 11/1978 | Rivalto | 123/198 DB |
| 4,602,605 | 7/1986 | Adkins | 123/516 |
| 4,807,583 | 2/1989 | Thornthwaite et al. | 123/516 |
| 4,957,084 | 9/1990 | Krämer et al. | 123/447 |
| 4,960,088 | 10/1990 | Havemann et al. | 123/198 D |
| 5,095,880 | 3/1992 | Ricks | 123/516 |
| 5,509,392 * | 4/1996 | Schmitz | 123/516 |
| 5,598,817 * | 2/1997 | Igarashi et al. | 123/179.17 |
| 6,058,912 * | 5/2000 | Rembold et al. | 123/516 |

* cited by examiner

*Primary Examiner*—Henry C. Yuen
*Assistant Examiner*—Mahmoud Gimie
(74) *Attorney, Agent, or Firm*—Jay Drouillard

(57) ABSTRACT

A device for preventing fuel pump air ingestion in a diesel fuel system includes a diesel engine having a plurality of injectors. The injectors receive a supply of diesel fuel from a fuel injection pump at a high pressure. The fuel injection pump receives the supply of diesel fuel from a transfer pump at a transfer pressure through a transfer pressure gallery. The supply of diesel fuel is stored in a fuel tank coupled to the transfer pump through a fuel line. To prevent air from entering the diesel fuel system, a low pressure sensing switch is coupled to the transfer pressure gallery and senses the transfer pressure. When the transfer pressure drops below a predetermined pressure a controller disables the fuel injection pump. Once the transfer pressure rises above the predetermined pressure level the controller enables the fuel injection pump.

3 Claims, 1 Drawing Sheet

SYSTEM FOR PREVENTING FUEL PUMP AIR INGESTION

TECHNICAL FIELD

The present invention relates generally to diesel engines and, more particularly, to a system for preventing fuel pump air ingestion in a diesel engine.

BACKGROUND ART

Modern electronically controlled diesel distributor-type injection pumps control the delivery of fuel to the injectors by pumping the full stroke of the high pressure pumping plungers, and controlling the start and end of injection with a high pressure spill solenoid valve. These pumps also have "snubber" valves in the high-pressure delivery outlets. The snubber valves perform many functions, but mainly act as check valves in the delivery direction, allowing fuel to flow freely towards the injector, but controlling the return flow pressure drop in the fuel line with an orifice. This orifice allows the reflected pressure wave from the injector to dissipate back into the fuel distributor, so that the fuel delivery line pressure is dropped, preventing secondary injections.

If air is introduced into this high-pressure fuel pump section, it will collect in the high-pressure fuel line to the injector. The air will then be compressed by the action of the high-pressure pumping element and expanded back through the return flow orifice. The same compression and expansion action is repeated continuously, without the air being dispersed. As long as air is being continually compressed and expanded, insufficient injection pressure will be generated and fuel delivery through the fuel injector to the engine will be adversely affected. The result is an engine that cannot be started without mechanical (service) intervention, to bleed out the air in the high-pressure fuel line system.

If the vehicle operator allows the vehicle to run out of fuel, air will be delivered to the fuel injection system, eventually getting into the high pressure pumping chamber and injector fuel lines, causing the engine to cease operation due to fuel starvation. When the operator attempts to rectify this problem by adding fuel to the fuel tank and supply system, the air that is trapped in the high pressure pumping system will not be purged without mechanical (service) intervention.

Typically, other methods of preventing air ingress usually use the fuel tank level indicator system to warn that the vehicle is about to run out of fuel. Because of the large width to depth aspect ratio of typical vehicle fuel tanks, it is difficult to make this system accurate. Thus, there is the potential to shut down the vehicle even with measurable fuel quantity left in the tank.

The disadvantages associated with these conventional prevention methods have made it apparent that a new technique for preventing air ingestion in a diesel fuel pump is needed. Preferably, the new technique should be more accurate then a system using a fuel tank level indicator. The new system should also shut down the vehicle with as little measurable fuel left in the fuel tank as possible.

SUMMARY OF THE INVENTION

It is an object of the invention to provide an improved and reliable means for preventing fuel pump air ingestion. Another object of the invention is to provide a system which only shuts down the fuel system when a minimal amount of fuel remains in the fuel tank. An additional object of the invention is to allow easy priming of a fuel pump after running out of fuel.

In one preferred embodiment of the present invention, a device for preventing fuel pump air ingestion in a diesel fuel system includes a diesel engine having a plurality of injectors. The injectors receive a supply of diesel fuel from a fuel injection pump at a high pressure. The fuel injection pump receives the supply of diesel fuel from a transfer pump at a transfer pressure through a transfer pressure gallery. The supply of diesel fuel is stored in a fuel tank coupled to the transfer pump through a fuel line. To prevent air from entering the diesel fuel system, a low pressure sensing switch is coupled to the transfer pressure gallery and senses the transfer pressure. When the transfer pressure drops below a predetermined pressure a controller disables the fuel injection pump. Once the transfer pressure rises above the predetermined pressure level, the controller again initiates operation of the fuel injection pump.

The present invention achieves an improved and reliable means for preventing fuel pump air ingestion. Also, the present invention is advantageous in that it allows the vehicle to operate as long as practically possible before disabling the fuel system.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODE(S) FOR CARRYING OUT THE INVENTION

Figure 1:
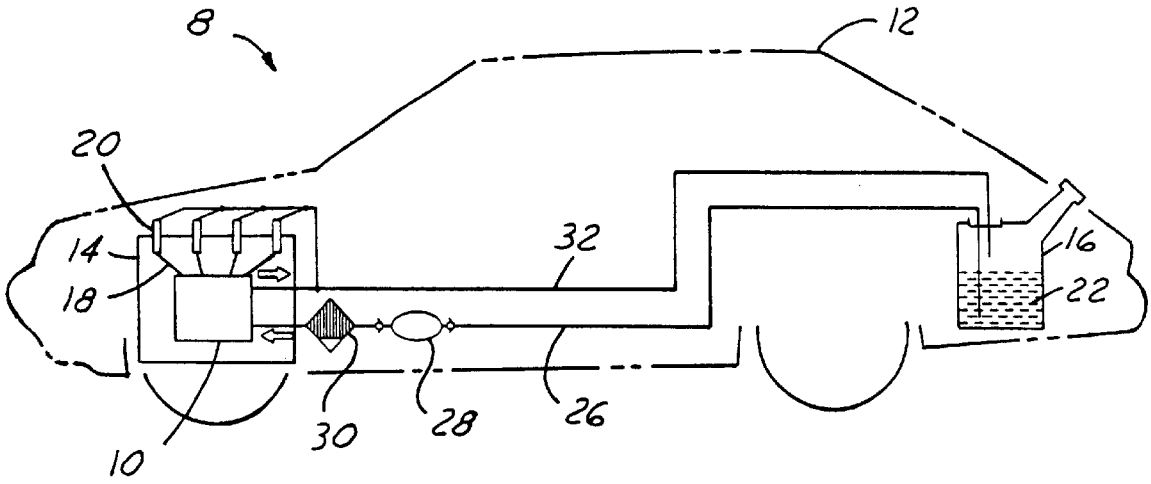
FIG. 1 depicts a diesel fuel system utilizing a device for preventing fuel pump air ingestion in accordance with the present invention.

Referring to FIG. 1, a diesel fuel system 8 is illustrated which includes a device 10 for preventing fuel pump air ingestion in accordance with the present invention. Diesel fuel system 8 includes a vehicle 12 having a diesel engine 14 and a fuel tank 16.

The diesel fuel system 8 is responsible for preventing fuel pump air ingestion. If air is introduced into the fuel system, it will collect in the high-pressure fuel line 18 to the injectors 20. The air will then be compressed by the action of the high-pressure pumping element and expanded back through the system. The same compression and expansion action is repeated continuously, without the air being dispersed. As long as this air is being continually compressed and expanded, insufficient injection pressure will be generated and fuel delivery through the fuel injector 20 to the engine 14 will be prevented. The result is an engine 14 that cannot be started without mechanical (service) intervention, to bleed out the air in the high-pressure fuel line system 18.

During normal operation of the diesel engine 14, in accordance with the present invention, the injectors 20 receive a supply of diesel fuel 22 from a device 10 for preventing fuel pump air ingestion 24 at a high pressure through high-pressure fuel lines 18. A snubber valve (not shown) is disposed in each high-pressure fuel line 18. Each snubber valve acts as a check valve in the delivery direction, allowing the supply of diesel fuel 22 to flow freely towards injector 20, but controlling the return flow pressure drop in high-pressure fuel line 18 with an orifice. The supply of diesel fuel 22 is stored in fuel tank 16 and is coupled to device 10 through a fuel line 26. Fuel line 26 includes a primer 28 and a fuel filter 30. Primer 28 is used to prime diesel fuel system 10 and may be any device capable of priming, i.e., a hand primer or an electric primer. Excess diesel fuel 22 and air is returned to fuel tank 16 through a fuel return line 32.

Figure 2:
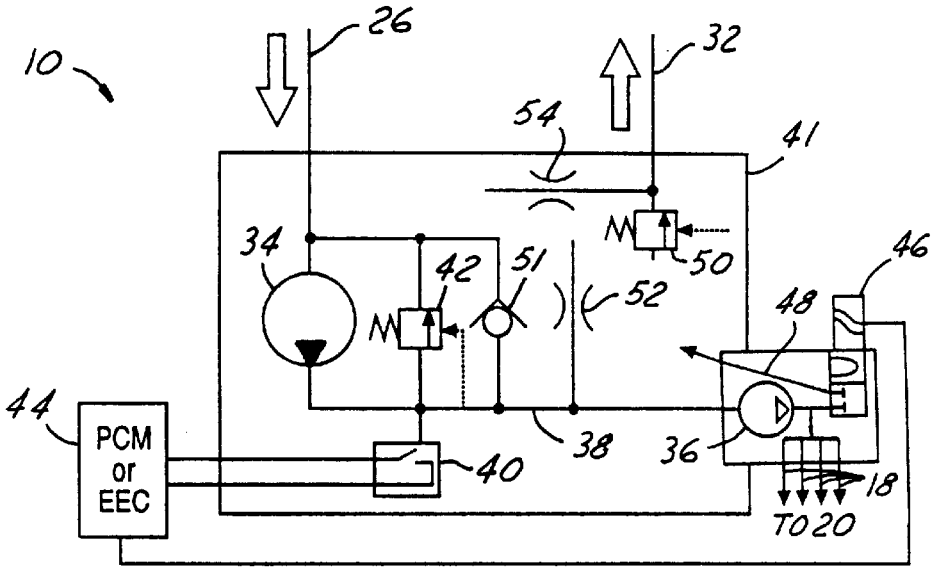
FIG. 2 is a device for preventing fuel pump air ingestion in accordance with a preferred embodiment of the present invention.

Referring to FIG. 2, a device 10 for preventing fuel pump air ingestion in accordance with a preferred embodiment of the present invention is illustrated. Device 10 includes a transfer pump 34 coupled to the fuel tank 16 through the fuel line 26. Transfer pump 34 delivers a supply of diesel fuel to fuel injector pump 36 through transfer pressure gallery 38. A low pressure sensing switch 40 is coupled to transfer pressure gallery 38 and senses transfer pressure. Fuel injector pump 36 delivers a supply of diesel fuel 22 to each fuel injector through high-pressure fuel lines 18. In a preferred aspect of the present invention, a fuel injection pump housing 41 encloses transfer pump 34, fuel injection pump 36, and low pressure sensing switch 40.

When the supply of fuel 22 in fuel tank 16 becomes low, a supply of air will be drawn into diesel fuel system 8. When the supply of air enters transfer pump 34, there will be a significant drop in fuel flow, causing a transfer pressure regulator 42 to close, further causing a fuel pressure drop in transfer pressure gallery 38. This pressure drop will eventually cause low pressure sensing switch 40 to signal a controller 44 at a predetermined pressure of the condition. One skilled in the art would recognize that controller 44 may be a stand alone controller or part of an electronic engine controller (EEC) or powertrain control module (PCM).

If controller 44 verifies that fuel tank 16 is almost empty, then controller 44 disables fuel injection pump 36. One method of verifying the accuracy of low pressure sensing switch 40 is to also monitor fuel level using a fuel tank level indicator switch. When a fuel tank level indicator switch is used, controller 44 will only disable fuel injection pump 36 when the pressure in transfer pressure gallery 38 drops below a predetermined pressure and the fuel level in fuel tank 16 drops below a predetermined level.

When fuel injection pump 36 is electronic or controlled by controller 44, then controller 44 may simply disable fuel injection pump 36 directly. One method of disabling diesel engine 14 is to activate an injection control solenoid valve 46 to divert the supply of fuel 22 from injectors 20 into fuel injection pump housing 41 through line 48. This excess fuel then returns to fuel tank 22 through a fuel injection pump housing regulator 50 and fuel return line 32.

To restart vehicle 12 after running low on fuel, a vehicle operator must add sufficient fuel to fuel tank 16 and prime diesel fuel system 8. Priming of diesel fuel system 8 is done using primer 28. In one aspect of the invention, when hand primer 28 is operated, the priming action will cause a supply of fuel 22 to travel towards fuel injection pump 26, bypassing transfer pump 34 and transfer pressure regulator 42, by means of bypass check valve 50.

Device should also allow the entrapped supply of air to travel to fuel return line 32. This is achieved by providing a transfer pressure continuous bleed orifice 52 from transfer pressure gallery 38, as well as a housing continuous bleed orifice 54 bypassing fuel injection pump housing pressure regulator 50, pushing all entrapped air back through fuel return line 32.

When all of the air is purged, resistance will be felt at hand primer 28, indicating that vehicle 12 may now be started. Cranking diesel engine 14 will raise the fuel transfer pressure, causing low pressure sensing switch 40, to discontinue its low-pressure signal to controller 44. This permits injection control solenoid valve 46 to resume normal operation, further permitting fuel to be delivered to injectors 20, allowing the diesel engine 14 to start.

In another aspect of the invention, when the vehicle operator adds sufficient fuel to fuel tank 16, but does not prime diesel fuel system 8, cranking diesel engine 14 will be sufficient. Cranking diesel engine 14 will cause transfer pump 34 to pull a supply of air and fuel 22 through fuel line 26, until only a supply of fuel 22 is in fuel line 26. Meanwhile, that supply of air entrapped in device 24, will be pushed through transfer pressure continuous bleed orifice 52 and housing continuous bleed orifice 54. Because air is still travelling through transfer pump 24, it will not generate sufficient pressure to operate transfer pressure regulator 42. This causes low pressure in transfer pressure gallery 38, which in turn causes low pressure sensing switch 40 to signal controller 44 to keep fuel injection control solenoid 46 open. When fuel without air reaches transfer pump 34, the fuel transfer pressure will rise, permitting the fuel injection control solenoid valve to resume normal operation and allowing diesel engine 14 to start.

From the foregoing, it can be seen that there has been brought to the art a new and improved system for preventing fuel pump air ingestion. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. A device for preventing fuel pump air ingestion in a diesel fuel system, the diesel fuel system comprising a diesel engine having a plurality of injectors, the injectors receiving a supply of diesel fuel from a fuel injection pump at a high pressure, the fuel injection pump receiving the supply of diesel fuel from a transfer pump at a transfer pressure through a transfer pressure gallery, the supply of diesel fuel stored in a fuel tank coupled to the transfer pump through a fuel line, the device for preventing fuel pump air ingestion comprising:

a low pressure sensing switch coupled to said transfer pressure gallery and sensing said transfer pressure, whereby said transfer pressure drops below a predetermined pressure when a supply of air enters said transfer pump;

a controller coupled to said low pressure sensing switch and said fuel injection pump, said controller disabling said fuel injection pump when said transfer pressure drops below said predetermined pressure, thereby preventing a supply of air from entering said fuel injection pump, said controller also reinstating operation of said fuel injection pump when said transfer pressure is above said predetermined pressure;

a transfer pressure continuous bleed orifice located in said transfer pressure gallery, said transfer pressure continuous bleed orifice allowing said supply of air to escape from said transfer pressure gallery when said diesel engine is primed, wherein said transfer pressure continuous bleed orifice vents said supply of air into said fuel injection pump housing; and a housing continuous bleed orifice located in said fuel injection pump housing, said housing continuous bleed orifice allowing said supply of air to escape from said fuel injection pump housing when said diesel engine is primed.

2. The device for preventing fuel pump air ingestion in a diesel fuel system as recited in claim 1, wherein said housing continuous bleed orifice vents said supply of air into said fuel tank.

3. A diesel fuel system comprising:

a vehicle;

a diesel engine located in said vehicle, said diesel engine having a plurality of injectors;

a fuel injection pump housing coupled to said diesel engine;

a fuel injection pump located in said fuel injection pump housing and providing a supply of diesel fuel at a high pressure to said fuel injectors;

a transfer pump located in said fuel injection pump housing and providing said supply of diesel fuel at a transfer pressure through a transfer pressure gallery to said fuel injection pump;

a fuel tank located in said vehicle and coupled to said transfer pump through a fuel line, said supply of diesel fuel stored in said fuel tank;

a primer located in said fuel line between said fuel tank for priming said diesel fuel system with said supply of diesel fuel located in said fuel tank;

a transfer pump bypass check valve located between said hand primer and said transfer pressure gallery, said transfer pump bypass check valve allowing said supply of diesel fuel to bypass said transfer pump from said fuel tank to said transfer pressure gallery;

a fuel tank level indicator switch located in said fuel tank, said fuel tank level indicator switch monitoring a fuel level of said supply of diesel fuel in said fuel tank;

a low pressure sensing switch coupled to said transfer pressure gallery and sensing said transfer pressure, whereby said transfer pressure drops below a predetermined pressure when a supply of air enters said transfer pump a controller coupled to said low pressure sensing switch, said fuel tank level indicator switch, and said fuel injection pump, said controller disabling said fuel injection pump when said transfer pressure drops below a predetermined pressure and said fuel level drops below a predetermined level, whereby said fuel injection pump does not receive a supply of air from said transfer pump, said controller enabling said fuel injection pump when said transfer pressure is above said predetermined pressure and said fuel level is above a predetermined level;

a transfer pressure continuous bleed orifice located in said transfer pressure gallery, said transfer pressure continuous bleed orifice allowing said supply of air to escape from said transfer pressure gallery to said fuel injection pump housing when said diesel engine is primed; and a housing continuous bleed orifice located in said fuel injection pump housing, said housing continuous bleed orifice allowing said supply of air to escape from said fuel injection pump housing to said fuel tank when said diesel engine is primed.

* * * * *